US006112335A

United States Patent [19]

Gaston

[11] Patent Number: 6,112,335

[45] Date of Patent: Sep. 5, 2000

[54] FOOT ACTUATED, ANTI-SLAMMING, TOILET SEAT RAISING AND LOWERING DEVICE

[76] Inventor: Jeff C. Gaston, 1622 Wilson, San Angelo, Tex. 76901

[21] Appl. No.: 09/309,132

[22] Filed: May 10, 1999

[51] Int. Cl.[7] ..... A47K 13/10

[52] U.S. Cl. ..... 4/246.1; 4/246.3; 4/246.4; 4/246.5; 4/248

[58] Field of Search ..... 4/246.1, 246.2, 4/246.3, 246.4, 246.5, 248

[56] References Cited

U.S. PATENT DOCUMENTS

| | | | |
|---|---|---|---|
| 4,103,371 | 8/1978 | Wilson | 4/251 |
| 4,551,866 | 11/1985 | Hibbs | 4/251 |
| 4,592,097 | 6/1986 | Zimmerman | 4/251 |
| 5,237,708 | 8/1993 | Zamoyski | 4/246.3 |
| 5,369,814 | 12/1994 | Denys | 4/246.2 |
| 5,488,743 | 2/1996 | Alfonso | 4/246.1 |

*Primary Examiner*—Henry J. Recla
*Assistant Examiner*—Khoa Huynh

[57] ABSTRACT

An improved foot actuated, anti-slamming, toilet seat raising and lowering device providing smooth operation during both phases. A foot-receiving lever is pivotally attached to a fulcrum which is floor mounted on preferred side of toilet. A lift lever and a hydraulic device are pivotally attached to the foot lever. A smooth rod extends upward out the top of hydraulic device, is bent at a right angle, bisects top of lift lever and pivotally attaches to a bracket mounted to bottom of toilet seat. As foot pressure is applied to the foot lever the lift lever is pushed upward raising the toilet seat and toilet cover, if down, toilet cover will assume its vertical resting position. The hydraulic device, having an internal stop, will arrest toilet seat lift at a point previous to perpendicular, preventing slamming. When foot pressure is removed from foot lever gravity affects toilet seat to descend. The hydraulic device dampens the descent providing reseating without slamming. Toilet seat descent is not affected by abrupt removal of applied foot pressure.

3 Claims, 3 Drawing Sheets

FOOT ACTUATED, ANTI-SLAMMING, TOILET SEAT RAISING AND LOWERING DEVICE

CROSS-REFERENCE TO RELATED APPICATIONS

Not applicable.

BACKGROUND

1. Field of Invention

This invention relates to foot actuated toilet seat raising and lowering devices.

2. Description of Prior Art

There have been numerous attempts in the prior art to produce a commercially viable and consumer acceptable toilet seat lifting and/or lowering device. Many are complex mechanisms which would be cost prohibitive to produce. Some require a user to manually raise a toilet seat before a device is activated to return seat to its horizontal position. Thus far, none appear to have obtained acceptance and use in the marketplace.

This lack of acceptance is believed to be contingent upon several factors: 1)they are too complex, thusly cost prohibitive, to be produced commercially, 2) they are too cumbersome to be easily maintained and 3) they are too complicated and/or time consumptive to be feasibly marketable.

U.S. Pat. No. 4,551,866 to Hibbs, Nov. 12, 1985, and U.S. Pat. No. 5,369,814 to Denys, Dec. 6, 1994, disclose two separate devices whereby toilet seat has to be manually raised, thereby hindering sanitary benefits. U.S. Pat. No. 5,488,743 to Alfonso, Feb. 6, 1996, employs multiple levers and foot pedals. Seat lowering is obtained through upward foot pressure in a stirrup receptacle. This arrangement could possibly affect user's balance. U.S. Pat. No. 5,237,708 to Zamoyski, Aug. 24, 1993, relies on a resilient material attached to foot pedal to aid in preventing slamming. The hardware employed to allow for toilet seat height variances would detract from salability. U.S. Pat. No. 4,103,371 to Wilson, Aug. 1, 1978, and U.S. Pat. No. 4,592,097 to Zimmerman, Jun. 3, 1986, are too complex to be marketed commercially.

It is a belief that the market would accept a device that provides for smooth operation, is aesthetically pleasing and that would be affordable, easily installed and maintained, convenient to use and promoting sanitary benefits.

SUMMARY

The preferred embodiment of the present invention consists of a foot lever attached to a fulcrum, which is situated on the floor adjacent to preferred side of toilet. A pivotally attached lift lever and a hydraulic device containing an operating fluid with pre-selected flow properties extend upward from the foot lever. A smooth rod extends outward from the hydraulic device, is bent at a right angle, passes through top of lift lever and is pivotally attached through a toilet seat bracket having a choice of attachment points to allow for variances in toilet bowl heights, and is held in place with a clevis pin.

The elements of this invention interact as follows to provide for non-slamming operation during toilet seat lift and reseating. As foot pressure is applied to foot lever the lift lever is pushed upward, raising toilet seat and lid, if also down. The toilet lid will assume its resting position against toilet tank. The smooth rod, being engaged through top of lift lever and attached to toilet seat bracket, is pulled outward from hydraulic device as toilet seat rises. Prior to toilet seat reaching a right angle with toilet bowl, toilet seat lift is arrested by a stop incorporated onto smooth rod portion sealed inside hydraulic device, thusly preventing slamming. When foot pressure is removed from foot lever, toilet seat descends, induced by gravity, the descent being dampened by beveled washers situated at lowest end of smooth rod interacting with operating fluid contained in hydraulic device.

Given that toilet seat weights vary, an operating fluid is incorporated to provide for these variances. The lighter the toilet seat, the slower the rate of descent.

OBJECTS AND ADVANTAGES

Accordingly, several objects and advantages of my invention are as follows:

(a.) base of invention can be secured to floor with either small suction cups or hook and loop fasteners to affect quick removal;

(b.) invention can be quickly adapted for installation to either side of toilet by simply moving the lift lever and hydraulic device to either the left or right side of the foot lever;

(c.) the only point of contact with toilet is the smooth rod where it pivotally attaches to the toilet seat bracket, this attachment provides for invention to be pivoted upward to rest against toilet tank to enable cleaning of floor around toilet;

(d.) invention can also be quickly removed from toilet by extracting clevis pin with thumb and forefinger. This allows for thorough cleaning of invention in tub or sink or any preferred method;

(e.) invention is light weight, durable and requires no maintenance;

(f.) hydraulic device is sealed and requires no adjustments, device provides for smooth operation and prevents slamming in both the lifting phase and reseating phase; and (g.) invention inhibits germ transmission in that it is solely foot operated.

Further objects and advantages of my invention will become apparent from a consideration of the drawings and ensuing description.

DRAWING FIGURES

REFERENCE NUMERALS IN DRAWINGS

| | | |
|---|---|---|
| 10 device | 20 clevis pin | 30 hydraulic device |
| 12 toilet seat bracket | 22 foot lever | 32 fluid retaining washer |
| 14 toilet seat | 24 fulcrum | 34 slip joint washer |

-continued

| | | |
|---|---|---|
| 15 toilet lid | 26 base | 36 E clip |
| 16 self-taping screws | 27 suction cups | 38 beveled washers |
| 18 smooth rod | 28 lift lever | |

DESCRIPTION—Preferred Embodiment

Figure 1:
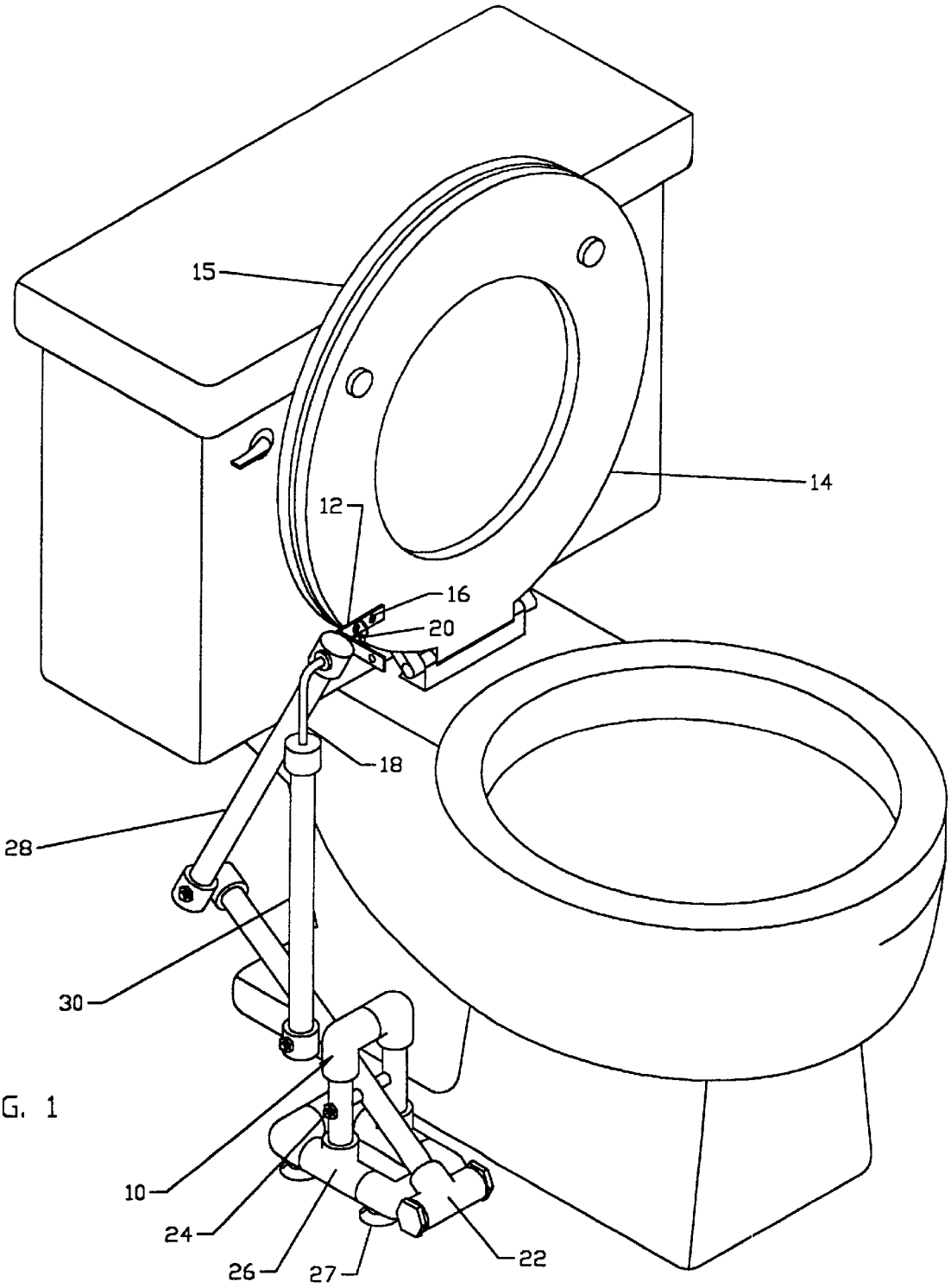
FIG. 1 is a perspective view showing invention attached to a toilet seat. The seat being in the raised position.

FIG. 1 is a perspective view showing toilet seat lifting reseating device 10, constructed of PVC pipe and fittings, attached to a toilet seat bracket 12 which in turn is attached to underside of toilet seat 14 with two self-taping screws 16. A smooth rod 18 is held to toilet seat bracket 12 with a clevis pin 20. A foot lever 22 is pivotally attached to a fulcrum 24, which is mounted on a base 26. Base 26 is constructed of PVC elbows and T's and is secured to floor with suction cups 27. A lift lever 28 is pivotally attached at opposite end of foot lever 22. Hydraulic device 30, which is constructed of PVC pipe and end caps, is pivotally attached at a point between lift lever 28 and fulcrum 24.

Figure 2:
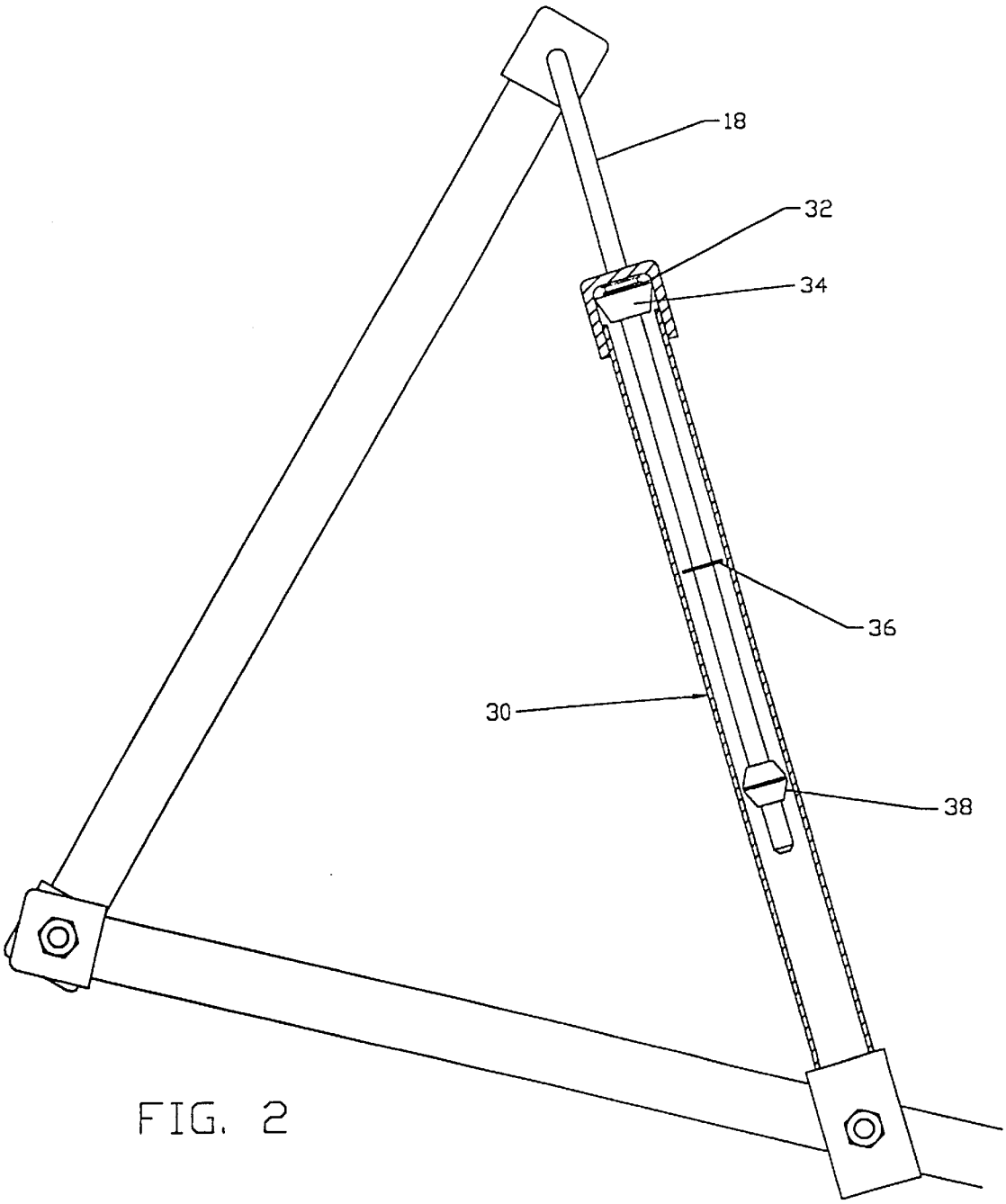
FIG. 2 is a detailed cut-away view showing the hydraulic device and its inner workings.

FIG. 2 is a detailed cut-away view of hydraulic device 30. A fluid retaining washer 32 is secured in place by a slip joint washer 34. An E clip 36 is pressed into a grooved notch at a pre-determined location on smooth rod 18. Two beveled washers 38 are pressed contiguously onto smooth rod 18 at its lowest end.

Figure 3:
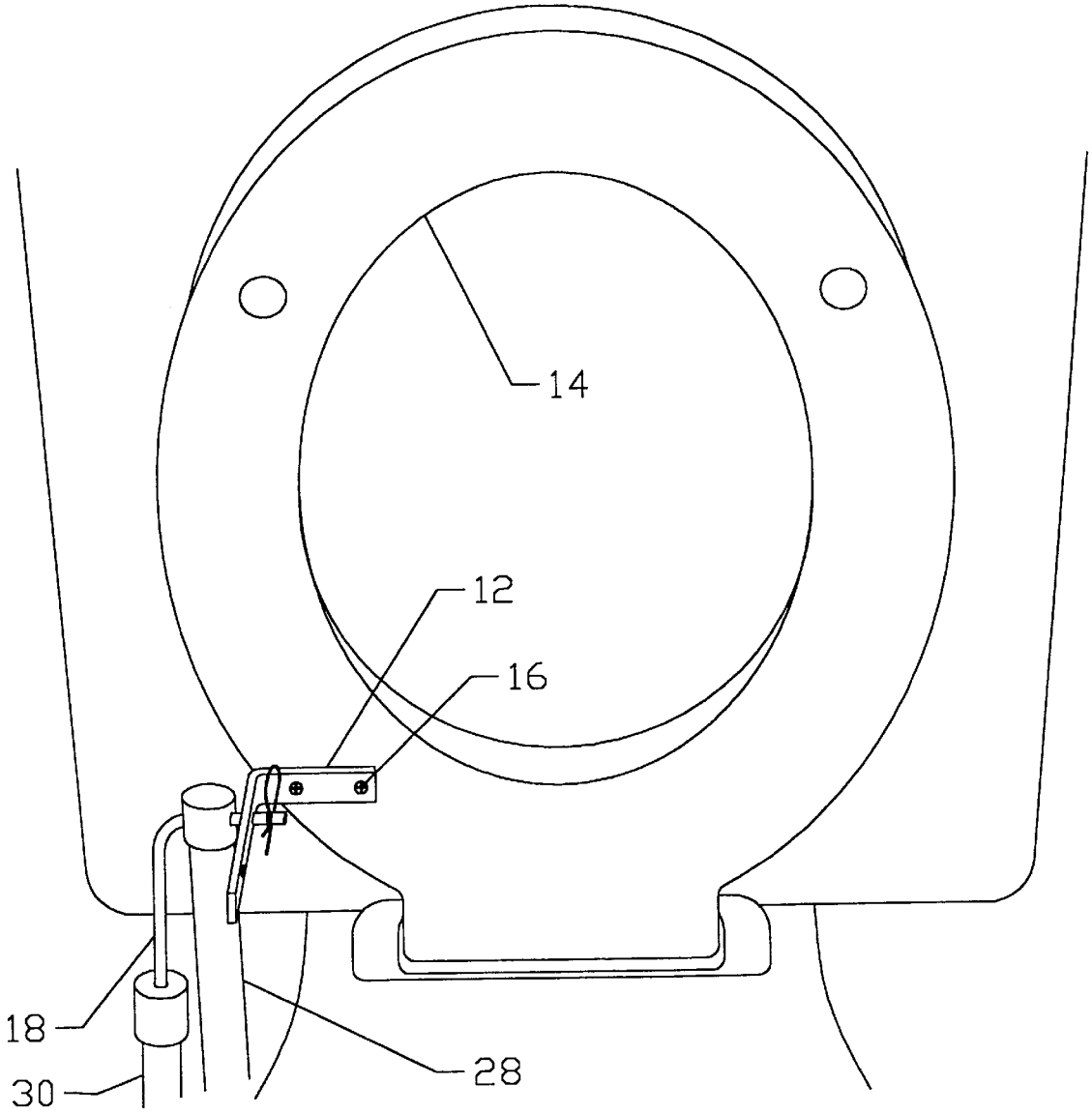
FIG. 3 is a detail view showing the attachment of the smooth rod to the toilet seat bracket.

FIG. 3 shows in detail the method of attachment of smooth rod 18 to toilet seat bracket 12. Toilet seat bracket 12 is secured to toilet seat 14 with two self-taping screws 16. Smooth rod 18 extends outward from hydraulic device 30 passes through lift rod 28, through an opening in toilet seat bracket 12 and is held in place by a clevis pin 20.

Operation—Preferred Embodiment

The described components perform together in the following manner to permit non-slamming operation in both the lifting and reseating of a toilet seat.

As user applies foot pressure to the foot-receiving end of foot lever 22, lift lever 28 is pushed upward causing toilet seat 14 and toilet lid 15, if down to rise. Toilet lid 15 will assume its upright position against toilet tank. As the seat 14 rises, the smooth rod 18 is pulled outward from hydraulic device 30. A fluid having pre-selected flow properties and sealed in hydraulic device 30 interacting with beveled washers 38 provides for a smooth lift. When toilet seat 14 reaches a point prior to perpendicular the E clip 36 engages the slip joint washer 34 to affect a stop point for toilet seat lift. The adjustment for this stop point is obtained by moving base 26 slightly, on a plane parallel to base of toilet. When user releases foot pressure from foot lever 22, gravity affects toilet seat 14 to begin its descent to its horizontal resting position. As toilet seat 14 descends, smooth rod 18 is pushed back into hydraulic device 30. Again, beveled washers 38, interacting with operating fluid in hydraulic device 30 provide for a smooth non-slamming return of the toilet seat 14.

Conclusions, Ramifications, and Scope of Invention

The described invention provides for an inexpensively manufactured toilet seat lifting and reseating device that should be readily affordable by the public. Device could have both residential and commercial applications.

With the exception of the hydraulic device, which must define an inside diameter, any form of tubing or solid rod material can be utilized in the manufacturing process. Materials such as aluminum, copper, brass, PVC and ABS plastics and steel. Any number of finishes can be applied so that device would attain the appearance of a bona fide toilet accessory. These finishes range from chrome plating, porcelain enamel, oil base enamel, acrylic, aluminum and epoxy finishes to bare finishes to affect an antique or rustic appearance.

As stated, device can be secured to floor with small suction cups allowing for effortless removal for cleaning. This method would render unnecessary any expensive or elaborate mounting processes that could scar flooring, be time consumptive, and contribute to retail pricing. For carpet applications, hook and loop fasteners having a self-adhesive on one side, would be utilized. This method could also be utilized for all applications, if desired, in lieu of suction cups.

Device is maintenance free other than periodic cleaning at user's discretion. Hydraulic device is sealed and requires no adjustments.

In the event that toilet seat is forcibly raised by hand to its upright resting position, the stop mechanism incorporated onto the smooth rod is amply sturdy to pry device from its mounting on floor, thereby preventing damage to device.

While the above descriptions may contain specificities, they should not be construed as limitations on the scope of the invention, but rather as an exemplification of one preferred embodiment thereof Other variations are possible.

I claim:

1. A foot actuated device for raising and lowering a hinged toilet seat preventing slamming in both seat raising and seat lowering comprising:

a.) a fulcrum attached to floor parallel to base of toilet;

b.) a foot lever pivotally attached to said fulcrum, having a foot receiving end and an opposite end;

c.) a lift lever having a first end pivotally attached to said foot lever opposite end and an opposite second end;

d.) a hydraulic device pivotally attached to said foot lever between said fulcrum and said lift lever, said hydraulic device defining an inside diameter and having an open end through which a smooth rod is slidably disposed, said smooth rod having a first end and an opposite end, said opposite end extending through said open end to exterior of said hydraulic device;

e.) a toilet seat bracket attached to underside of said toilet seat, said opposite end of said smooth rod having a right angled extension which pivotally traverses through said opposite second end of said lift lever and further pivotally traverses said toilet seat bracket.

2. Apparatus as in claim 1 wherein said hydraulic device comprises:

a.) a cylinder defining said inside diameter and said open end and containing an operating fluid having pre-selected flow properties;

b.) said smooth rod having said first end slidably disposed within said cylinder and said opposite end extending through said open end;

c.) a fluid retaining washer held in place inside top of said cylinder by a slip joint washer, said smooth rod travels reciprocally through said fluid retaining washer and said slip joint washer;

d.) two beveled washers having an outside diameter less than inside diameter of said cylinder, said beveled washers are pressed contiguously onto said first end of said smooth rod;

e.) a stop mechanism rigidly attached to said smooth rod at a pre-determined location between said beveled washers and said slip joint washer to affect means for stopping said toilet seat lift, whereby when foot pressure is applied to said foot lever said lift lever is pushed upward, raising said toilet seat and toilet lid, if down, said toilet lid will assume its vertical resting position against toilet tank, said smooth rod being engaged through top of said lift lever is pulled outward from said cylinder in relation to said toilet seat lift, at a point before said toilet seat reaches a right angle with toilet bowl said stop mechanism engages said slip joint washer to arrest said toilet seat lift, when said foot pressure is removed from said foot lever said toilet seat descends, induced by gravity, said beveled washers situated at said first end of said smooth rod provide resistance with said operating fluid to dampen said toilet seat descent as said smooth rod is pushed back into said cylinder in relation to said toilet seat descent.

3. Apparatus as in claim 1 wherein said toilet seat bracket is right angled and has a choice of openings for said smooth rod attachment to provide for variances in toilet bowl heights.

* * * * *